US012605620B1

(12) United States Patent
Elwin et al.

(10) Patent No.: US 12,605,620 B1
(45) Date of Patent: Apr. 21, 2026

(54) ELECTROMAGNETIC NEWTON BALL AND BALL DIVERTER ASSEMBLY FOR A PINBALL MACHINE

(71) Applicant: Stern Pinball, Inc., Elk Grove Village, IL (US)

(72) Inventors: Keith Elwin, Elk Grove Village, IL (US); J. Harrison Drake, Jr., Elk Grove Village, IL (US); Richard J Naegele, Elk Grove Village, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 408 days.

(21) Appl. No.: 18/330,870

(22) Filed: Jun. 7, 2023

Related U.S. Application Data

(60) Provisional application No. 63/349,877, filed on Jun. 7, 2022.

(51) Int. Cl.
*A63F 7/30* (2006.01)
*A63F 7/02* (2006.01)

(52) U.S. Cl.
CPC ..... *A63F 7/3075* (2013.01); *A63F 7/027* (2013.01)

(58) Field of Classification Search
CPC ..... A63F 7/3075
USPC ..... 273/121 A
See application file for complete search history.

(56) References Cited

U.S. PATENT DOCUMENTS

| | | | | | |
|---|---|---|---|---|---|
| 4,221,384 | A * | 9/1980 | Krynski | A63F 7/3065 | 273/127 R |
| 4,840,375 | A * | 6/1989 | Lawlor | A63F 7/027 | 273/121 A |
| 5,324,034 | A * | 6/1994 | Gottlieb | A63F 7/027 | 273/127 R |
| 5,338,031 | A | 8/1994 | Patla, Sr. et al. | | |
| 5,474,292 | A | 12/1995 | Anghelo et al. | | |
| 5,507,488 | A | 4/1996 | Eddy et al. | | |
| 5,511,783 | A | 4/1996 | Popadiuk et al. | | |
| 5,518,236 | A * | 5/1996 | Morrison | A63F 7/3075 | 273/127 R |
| 5,673,913 | A * | 10/1997 | Toler | A63F 7/027 | 273/121 A |
| 6,158,737 | A | 12/2000 | Cornell et al. | | |
| 10,926,166 | B1 | 2/2021 | Drake, Jr. et al. | | |
| 12,172,091 | B1 * | 12/2024 | Eddy | A63F 7/0088 | |
| 2002/0175677 | A1 * | 11/2002 | Proksch | G01D 5/2291 | 324/207.18 |
| 2007/0026918 | A1 | 2/2007 | Sheats | | |
| 2015/0001796 | A1 * | 1/2015 | Stellenberg | A63F 7/26 | 273/121 A |

(Continued)

*Primary Examiner* — Allyson N Trail
(74) *Attorney, Agent, or Firm* — Greenberg Traurig, LLP

(57) ABSTRACT

A ball momentum transfer assembly for a pinball machine includes a guide assembly, a travel ball, a target element and a magnetizable impact object. The travel ball is located within a captive ball travel area defined by the guide assembly such that the travel ball rests against the impact object to receive momentum from an impact against the impact object when the impact object is struck by a game ball moving across the playfield to cause the travel ball to impact the target element and upon impact, selectively magnetize or demagnetize the impact object. A ball sensor assembly may be mounted adjacent the guide assembly and configured to detect the presence of the game ball moving proximate the impact object and divert the game ball as desired.

20 Claims, 9 Drawing Sheets

(56) References Cited

U.S. PATENT DOCUMENTS

2016/0121203 A1* 5/2016 Gomez ..... A63F 7/3075
273/118 A

* cited by examiner

ELECTROMAGNETIC NEWTON BALL AND BALL DIVERTER ASSEMBLY FOR A PINBALL MACHINE

CROSS REFERENCE TO RELATED APPLICATION

This application is a non-provisional application claiming priority from U.S. Provisional Application Ser. No. 63/349,877, filed Jun. 7, 2022, and incorporated herein by reference in its entirety.

FIELD OF THE DISCLOSURE

The present description relates generally to an amusement device, such as a pinball machine, and more particularly to an electromagnetic newton ball and ball diverter assembly for a pinball machine.

BACKGROUND OF RELATED ART

Amusement game devices, such as pinball machines, redemption games, etc. of the commercial, e.g., revenue generating, and non-commercial, e.g., home entertainment, type are well known in the art. By way of example, U.S. Pat. Nos. 5,338,031, 6,158,737, and U.S. Published Application No. 2007/0026918 illustrate and describe amusement game devices of the type having a cabinet which houses a playfield.

Most pinball games include structures such as ramps, tracks and lanes to define paths of travel for the ball on the playfield. It is known in the art to provide obstructions or mechanical ball diverter gates in these paths to control the movement of the ball on the playfield and to control access to other play features. For example, U.S. Pat. No. 5,507,488 describes a ball diverter located in a ramp or other ball path, where the ball diverter is moveable between first and second positions and is used to selectively divert a pinball between two paths. The mechanism for moving the diverter includes two solenoid coils which are arranged such that the diverter can be held in either the first or second position indefinitely without either solenoid being continuously actuated.

Similarly, U.S. Pat. No. 5,474,292 describes a mechanical pinball diverter mechanism for use in directing a ball in a pinball game having an entry path and first and second exit paths. The ball diverter mechanism comprises a solenoid having a plunger movable between a first position wherein the plunger is extended and a second position wherein the plunger is retracted, a first ball contacting surface linked to the plunger, and a second ball contacting surface also linked to the plunger. When the plunger is in the first position, the ball will engage the first ball contacting surface and travel under the second ball contacting surface to cause the ball to be diverted from the entry path to the first exit path. When the plunger is in the second position, the ball will engage the second ball contacting surface and travel over the first ball contacting surface to cause the ball to be diverted from the entry path into the second exit path.

Further, newton ball assemblies have been utilized in pinball machines to detect ball locations and impacts with stationary objects. For instance, in one example, a pinball game includes a linear ball momentum transfer feature, such as described in U.S. Pat. No. 5,511,783. The pinball momentum transfer device utilizes an impact ball anchored to the playfield. Momentum can be transferred from a game ball via the impact ball so as to project the captive ball towards a target element contained within a confined area.

Finally, U.S. Pat. No. 10,926,166 discloses a rotatable ball momentum transfer assembly including an impact ball mounted to an inclined playfield and a shaft mounted to the playfield proximate to the impact ball. A travel ball is coupled to the shaft such that the travel ball rests against the impact ball during gameplay to receive momentum from the impact ball when the impact ball is struck by a game ball, causing the travel ball to at least partially rotate about the shaft. The travel ball rotates in a fixed arc towards one of two resting positions on either side of the impact ball. These two resting positions both open or close different shot paths available during gameplay.

While the above-referenced patents and applications may be suitable for their intended purposes, there is an identifiable need for improvement thereto.

BRIEF DESCRIPTION OF THE DRAWINGS

For a better understanding of the electromagnetic newton ball and ball diverter assembly disclosed hereinafter reference may be had to the following drawings.

DETAILED DESCRIPTION

The following description of example methods and apparatus is not intended to limit the scope of the description to the precise form or forms detailed herein. Instead, the following description is intended to be illustrative so that others may follow its teachings.

Referring now to the figures, an example amusement device, such as a pinball machine having a playfield layout, is illustrated. In this example, the pinball machine includes an electromagnetic ball diverter assembly for selectively activating during gameplay to alter or otherwise influence the travel characteristics of a gameplay ball.

With reference to the figures, an amusement game device, in the example form of a pinball machine 10 is now described. It is to be appreciated, however, that this example form for the amusement game device is not intended to be limiting. Rather, those of ordinary skill in the art will appreciated that the example electromagnetic ball diverter assembly disclosed hereinafter can be utilized in any type of amusement game device of the commercial and non-commercial type in which it is desired to operate a mechanism as disclosed.

Figure 1:
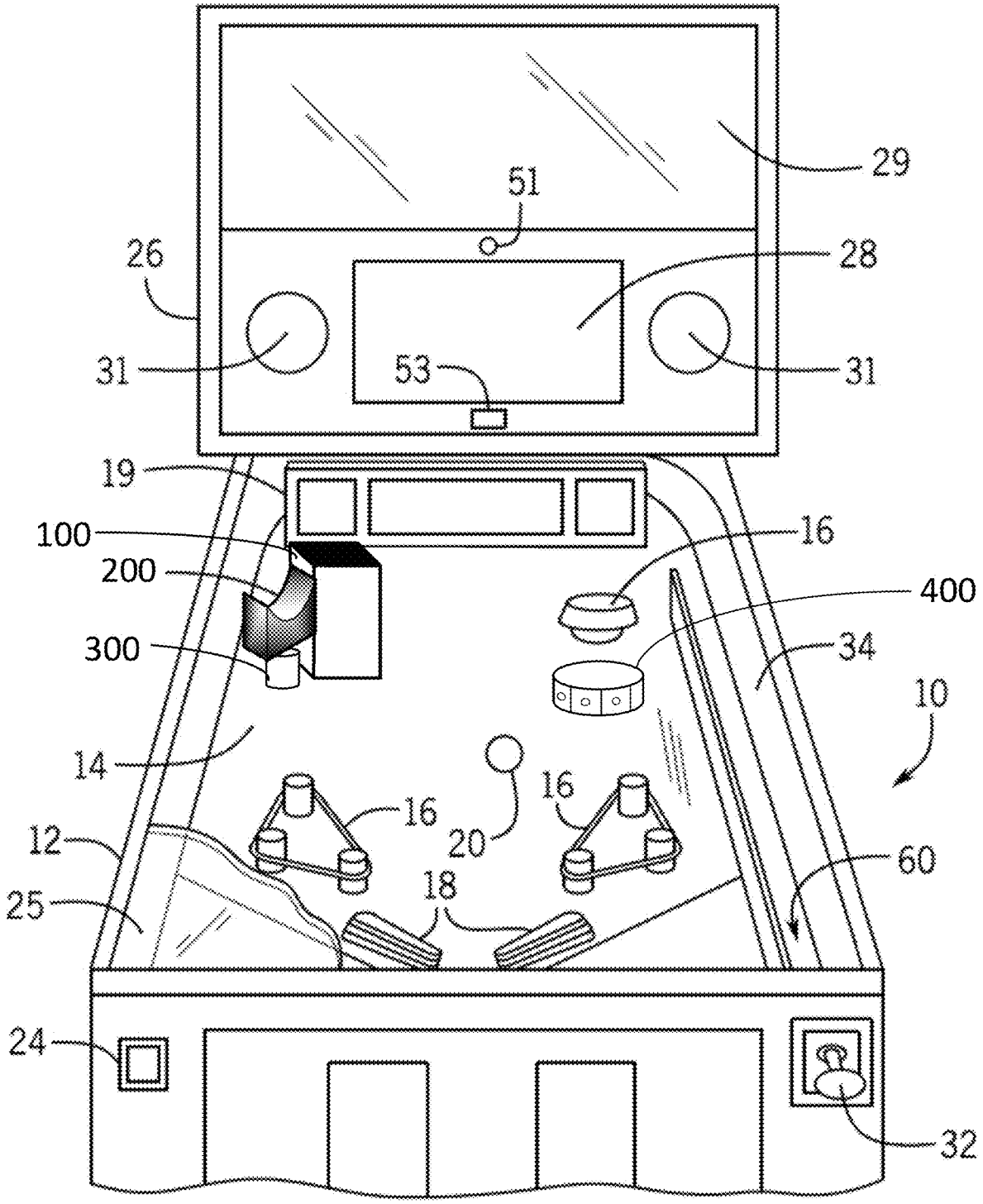
FIG. 1 illustrates an example amusement game device in the form of a pinball machine including an example of the disclosed electromagnetic newton ball and ball diverter assembly.

The example pinball machine 10 illustrated in FIG. 1 includes a cabinet 12 which houses various apparatus used to define play of a game (e.g., "gameplay"). Gameplay may be commenced in response to insertion of money, paper or coins referred to collectively as "coins", into a coin accepting device, upon exercising of credits earned, by accepting payment from an account, e.g., via use of a swipe card reading device, a bar code reading device, a QR code reading device, a near field communications device, etc., and/or by otherwise making gameplay active, including free play. Upon activation of the game in this manner, gameplay, in the case of the example pinball machine 10, is defined upon an inclined playfield 14 that supports a number of playfield elements, accessories, and/or devices.

Figure 4:
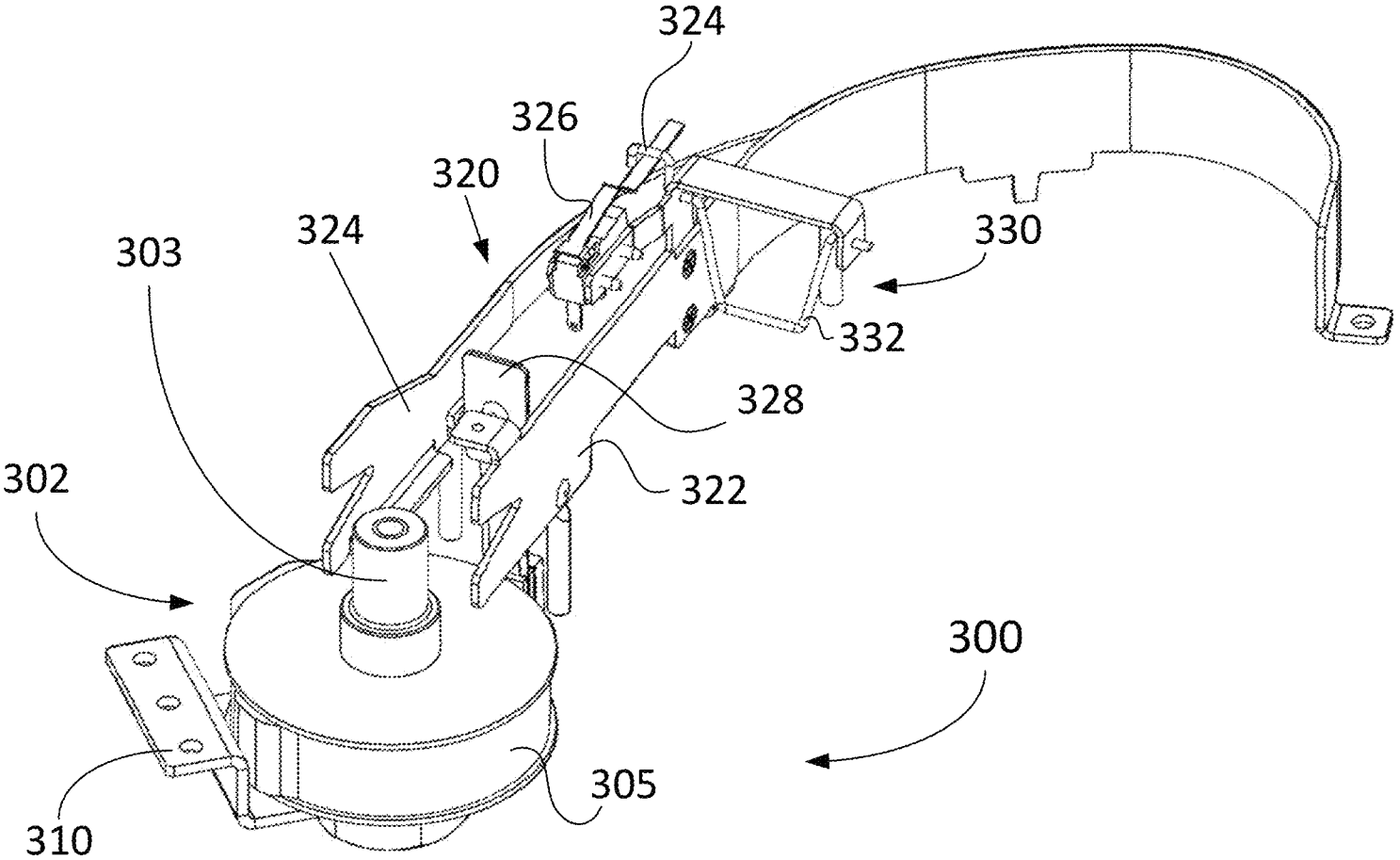
FIG. 4 is perspective view of an example electromagnetic newton ball and ball diverter assembly for a pinball machine.

More particularly, in the case of the example pinball machine 10, gameplay is generally defined through the use of a pair of pivotable, flippers 18 to propel a game ball such as a ball 20 for movement relative to an upper side (e.g., a top surface) of the playfield 14 and input devices/accessories associated with the playfield 14. In this example the playfield 14 also includes a backpanel 19 located near an upper portion of the playfield 14 away (e.g. distally located) from the player and the flippers 18. In this example, the backpanel 19 stands upright (e.g., vertical) from the playfield 14. While generally described as being horizontal, the playfield 14 is usually inclined from the horizontal, such as for instance between approximately 6.5 to 7.0 degrees, such that the ball tends to eventually roll back down the playfield 14 in the direction of the flippers 18. While not intended to be limiting, the playfield accessories or input devices may include elements such as bumpers 16, targets (e.g. drop bank targets, spinner targets, etc.) which will be described in greater detail hereinafter. With the present disclosure, the targets, ramps, ball pathways, etc., may include a tiered structure 100, a bridge 200, an electromagnet newton ball and ball diverter assembly 300, and a rotating target assembly 400. These specific components may include specialized functionality (see FIG. 4 et. seq.) as will be described.

The playfield 14 may be covered by a transparent or glass sheet cover 25 to permit viewing of the playfield 14. In addition to the foregoing, the playfield 14 typically includes a plunger element 32 which shoots or launches the ball 20 up an alley 34 onto the playfield 14. The playfield 14 may also include lighting elements—which may also be included as a part of the any of the input devices/accessories—and/or other features as desired. Other player-activated input elements, typically in the form of push-buttons (not shown) on the sides (or other location) of the cabinet 12, are usually provided for controlling operation of the flippers 18 or otherwise interacting with gameplay. The pinball machine 10 may also include a backbox 26 which is mounted to overlay a top rear portion of the cabinet 12 and which in this example contains artwork 29, and a display 28, such as a dot matrix display, CRT, LED or plasma display, or the like. The backbox 26 may also support speakers 31 associated with the game sound system. Within the backbox 26 may be located various ones of the electronic devices/circuits for controlling the operation of the playfield 14, the display 28, general illumination, and the sound system, including the speakers 31 and any additional sound system components. Such electronic devices/circuits could also, in whole or in part, be carried within the cabinet 12, or may be external to the game cabinet and linked to the pinball machine 10 via any suitable wired or wireless configuration.

Figure 2:
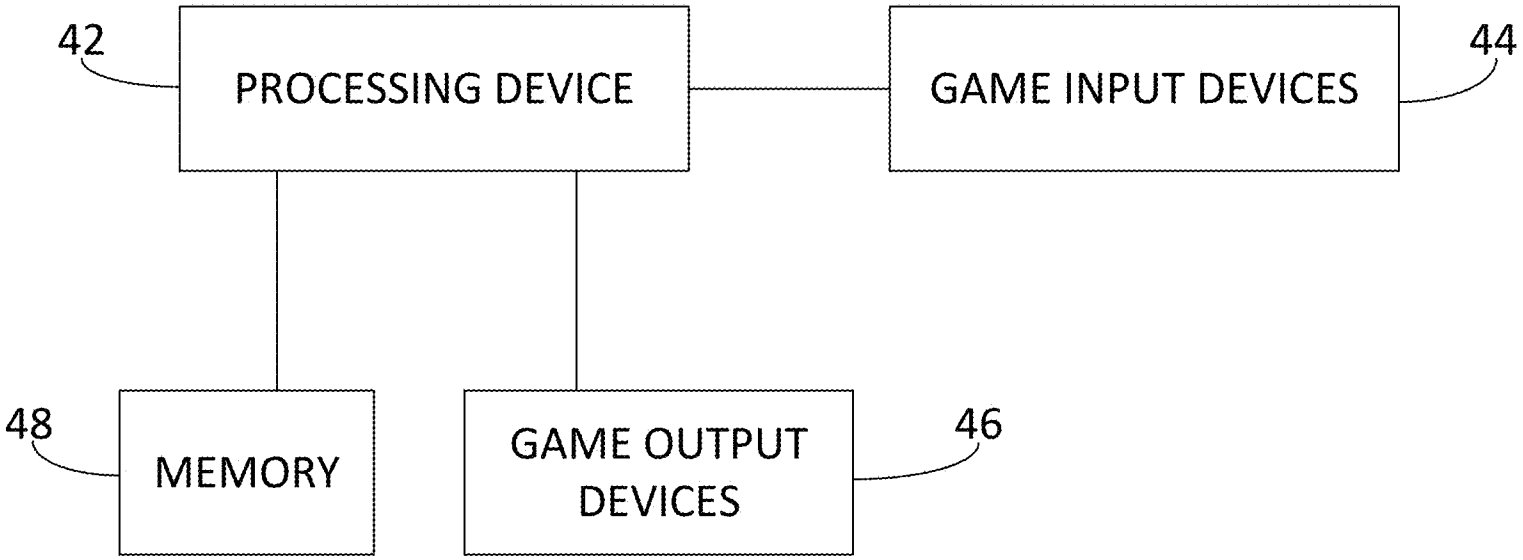
FIG. 2 is an example block diagram of example components of the amusement game device of FIG. 1.

Referring to FIG. 2, for controlling the various devices that form the amusement game, the example pinball machine 10 is provided with a processing device 42 which processing device 42 is, in turn, coupled to game input devices 44, such as switches associated with the cabinet 12 or the playfield 14, and game output devices 46, such as lights (including lights associated with the playfield), the bumpers 16, the flippers 18, the targets, the display 28, the tiered structure 100, the bridge 200, the electromagnet newton ball and ball diverter assembly 300, the rotating target assembly 400, etc. via one or more bus systems. A memory device 48, such as a RAM, ROM, or the like, stores instructions and data usable by the processing device 42 to control gameplay, the game output devices 46, and the game input devices 44 as necessary based upon signals provided by the game input devices 44. It is to be understood that this illustrated embodiment is not intended to be limiting and that other manners for arranging the devices illustrated in FIG. 2 to provide for control of play of the amusement game can be utilized as needed.

Figure 3:
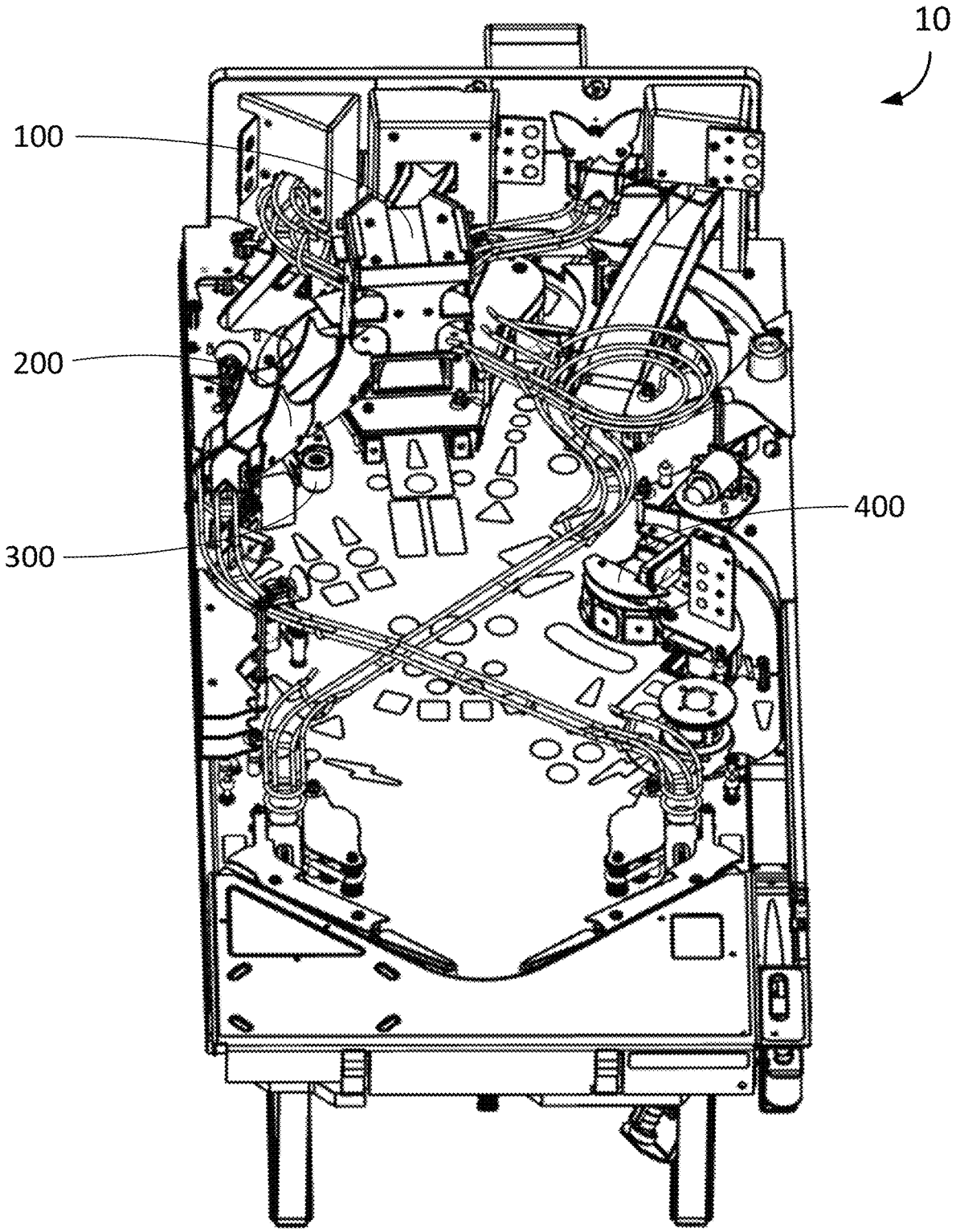
FIG. 3 is a perspective view of an example pinball playfield, including a plurality of gameplay features as disclosed herein.

As also illustrated in FIG. 3, more precisely, the example pinball machine 10 includes the tiered structure 100, which is configured to move in a direction perpendicular to a plane defined by the playfield 14 to provide access for the ball 20 to each of the various tiers that form the tiered structure 100. The tiered structure 100 is described in greater depth in the patent application filed Jun. 7, 2023, and assigned U.S. Ser. No. 18/330,839, the contents of which are incorporated herein in their entirety and for all purposes.

The example pinball machine 10 also includes the bridge 200, which is formed by two separate components configured to rotate independently of one another. In response to a single mechanical input, the separate components rotate and simulate a collapse of the bridge 200, such that one of the separate components functions as a ramp rather than as gap-traversing path. The bridge 200 is described in greater depth in the patent application filed Jun. 7, 2023, and assigned U.S. Ser. No. 18/330,931, the contents of which are incorporated herein in their entirety and for all purposes.

The example pinball machine 10 also includes the electromagnet newton ball and ball diverter assembly 300, which is configured to provide an electromagnetic newton ball diverter. The electromagnet newton ball and ball diverter assembly 300 is described in greater depth herein below. As will be understood by one of ordinary skill in the art, the term "newton ball" assembly refers to a momentum transfer device wherein a stationary object transfers impact energy to a second object, such as a movable ball.

The example pinball machine 10 also includes the rotating target assembly 400, which is configured to provide a selectable, rotatable target and ramp combination. The rotating target assembly 400 is described in greater depth in the patent application filed Jun. 7, 2023, and assigned U.S. Ser. No. 18/330,915, the contents of which are incorporated herein in their entirety and for all purposes.

Referring now to FIGS. 4-7, various examples of a magnetic newton ball diverter are illustrated and disclosed including the electromagnet newton ball and ball diverter assembly 300. For purposes of this specification, the example electromagnet newton ball and ball diverter assembly 300 may also be interchangeably referred to as the "newton assembly 300" or other similar name.

Figure 5:
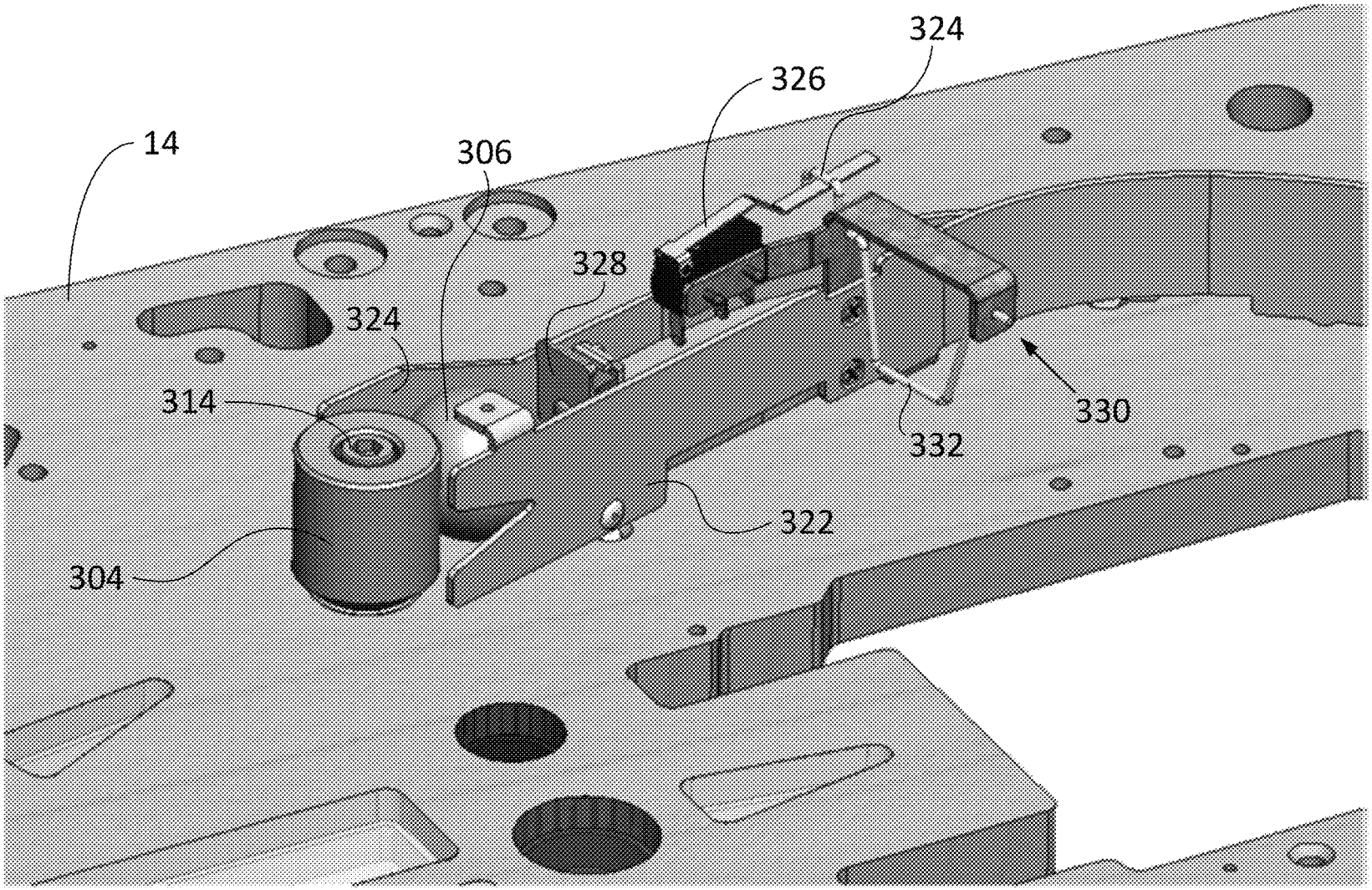
FIG. 5 is another perspective view of the example electromagnetic newton ball and ball diverter assembly of FIG. 4, showing the assembly installed on a pinball machine playfield.
Figure 6:
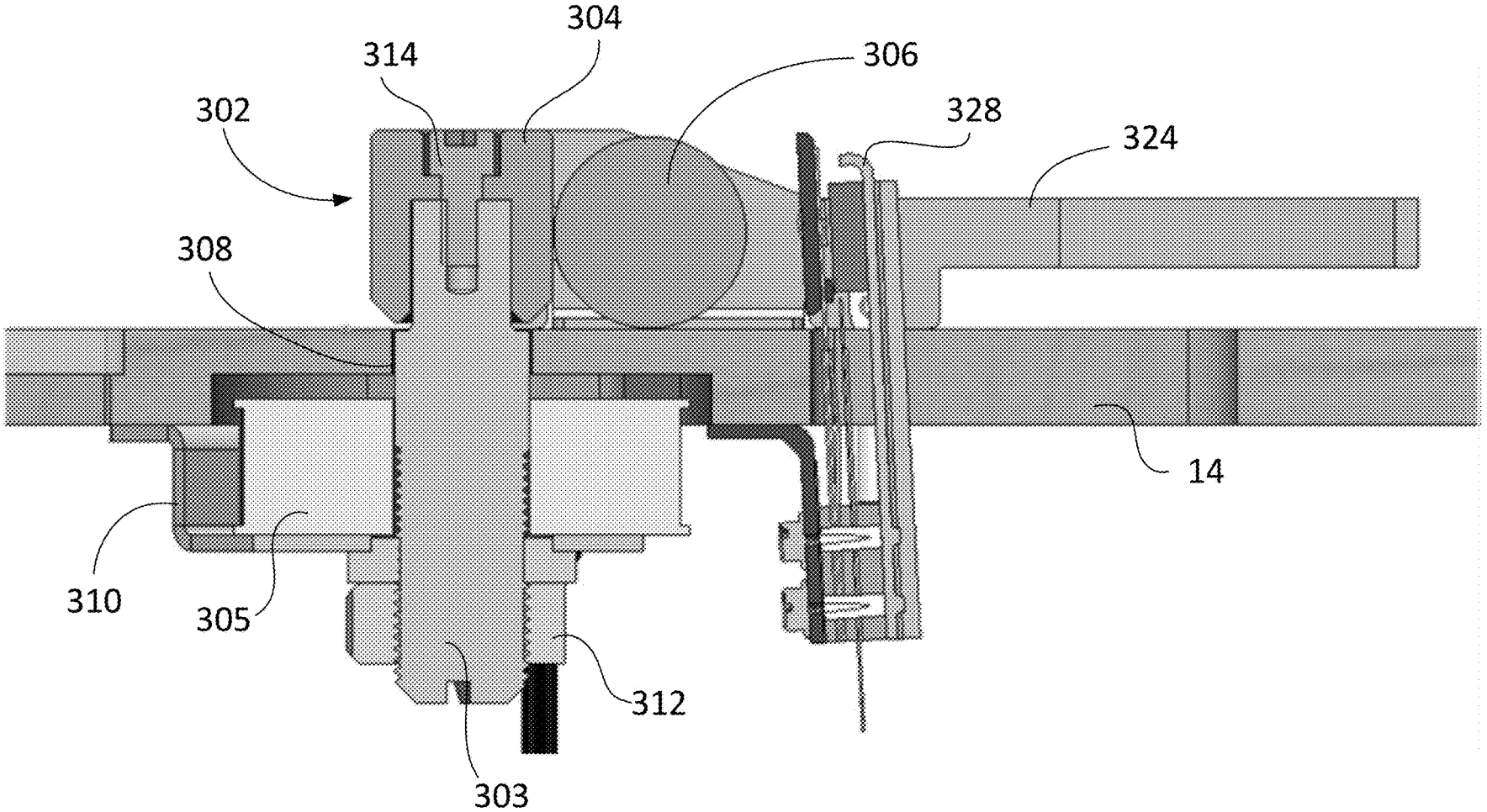
FIG. 6 is a side view of a vertical cross-section of some of the components of the example electromagnetic newton ball and ball diverter assembly of FIG. 4.
Figure 7:
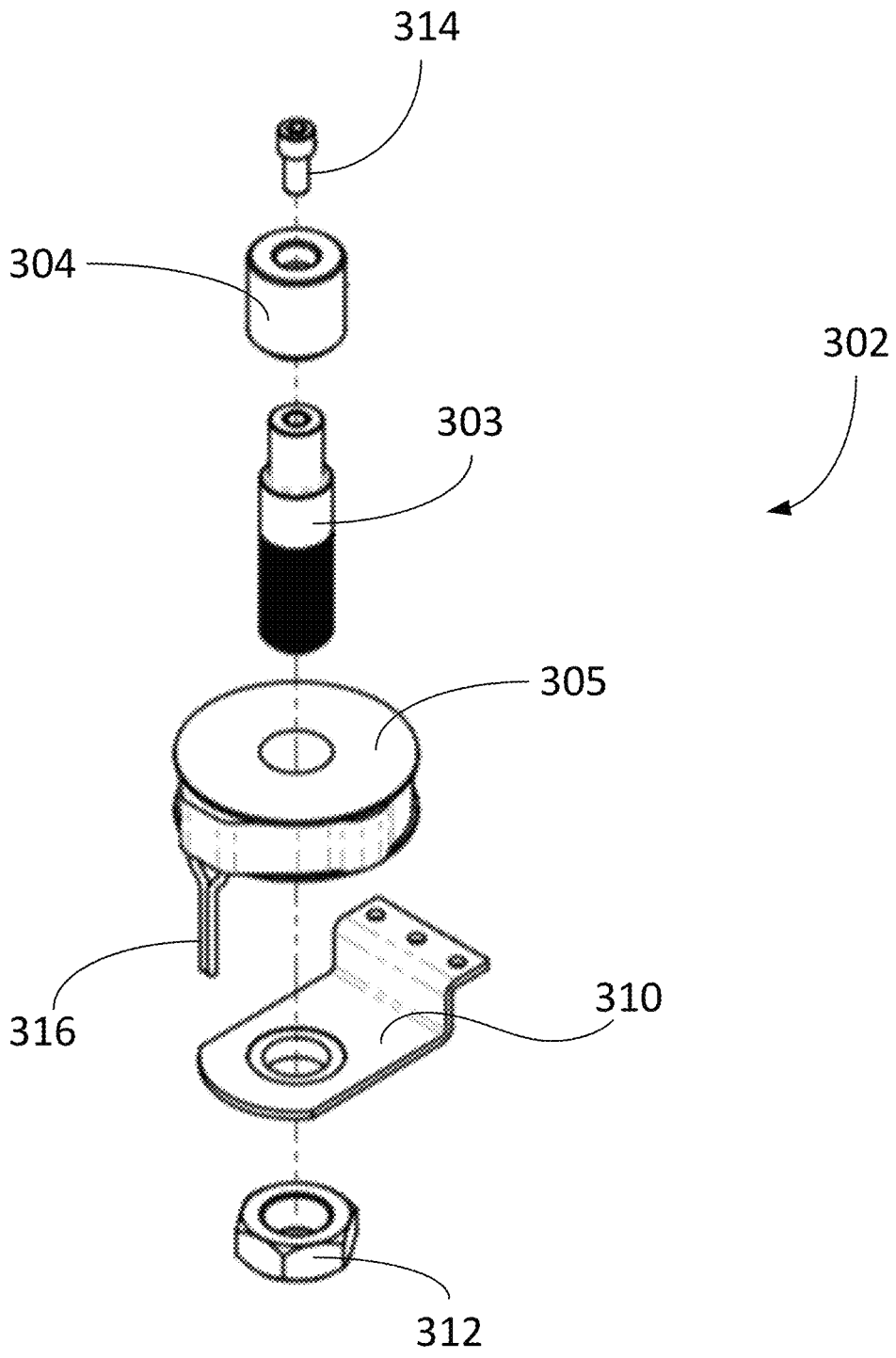
FIG. 7 is an exploded perspective view of an example electromagnet assembly for use with the example electromagnetic newton ball and ball diverter assembly of FIG. 4.

In general, the example newton assembly 300 includes an impact object, which in this instance is a selectably activated, electromagnet assembly 302 having a magnet core 303 surrounded by an electromagnetic coil 305 and having a stainless-steel magnet core cap 304 ("the cap 304"; see FIG. 5), and a travel object, such as a travel ball 306 (see FIG. 5). While the impact object and the travel object are respectively illustrated and described herein as an "electromagnet" and a "ball," it will be appreciated by one of ordinary skill in the art that either or both of the impact object and the travel object may be any suitable size, shape, and/or material that allows for the imparting of momentum between the devices and are not limited to the disclosed "electromagnet", "balls", or "pinballs". Furthermore, as will be discussed in further detail herein, in the example illustrated, the cap 304 may be provided to better prevent any of the machine components, including the ball 20 or the travel ball 306 from "sticking" or otherwise being attracted to the electromagnet assembly 302 due to any residual magnetism. The cap 304 may be maid of any suitable material and be of any suitable thickness, or may alternatively be eliminated as desired.

The electromagnet assembly 302 is mounted with the magnet core 303 extending through an opening 308 formed in the playfield 14 and anchored to the playfield 14, in this instance to an underside surface of the playfield 14, via any suitable fastener (not illustrated). For example, the electromagnetic coil 305 may be threaded onto the magnet core 303 and both components may be attached to a bracket 310 and secured via a fastener 312 (see FIG. 7). The cap 304 may be coupled to the magnet core 303 via any suitable device, including a threaded fastener 314. As illustrated, in this example the width of the cap 304 is greater than the width of the opening 308 to assist in the prevention of the electromagnet assembly 302 from moving through the opening 308. As will be appreciated by one of ordinary skill in the art, the electromagnetic coil 305 may include any suitable electrical connections, such as wires 316 that are electrically coupled to the pinball machine and selectively energized by the processing device 42 in response to various gameplay situations, thereby selectively magnetizing the magnet core 303.

A guide assembly 320 is mounted on the playfield 14, and in this instance, includes two upstanding side rails 322, 324 spaced apart at a distance slightly more than a diameter of the travel ball 306. The guide assembly 320 together with the side rails 322, 324 define a captive ball travel area where the travel ball 306 may travel as it is projected towards a target element 328. An optional cover (not shown) may be mounted to at least one of the side rails 322, 324 and over the travel ball 306 to further define the captive area. In this example, the target element 328 is a switch, such as a leaf spring switch as is known in the art.

In one mode of operation, the travel ball 306 rests against the cap 304 during play due to the incline of the playfield 14 but is otherwise unrestrained from moving. During play, the player, any of the interactive elements including the flippers 18, projects the ball 20 towards the cap 304 in order to engage it. When the ball 20 collides with the cap 304 in a sufficient location and with a proper velocity, the travel ball 306 is projected towards the target element 328, where an impact may be registered by the switch. During a sufficient collision with the cap 304, the ball 20 typically remains essentially in place against or near the cap 304 because the momentum of the ball 20 is transferred to the travel ball 306.

Figure 8:
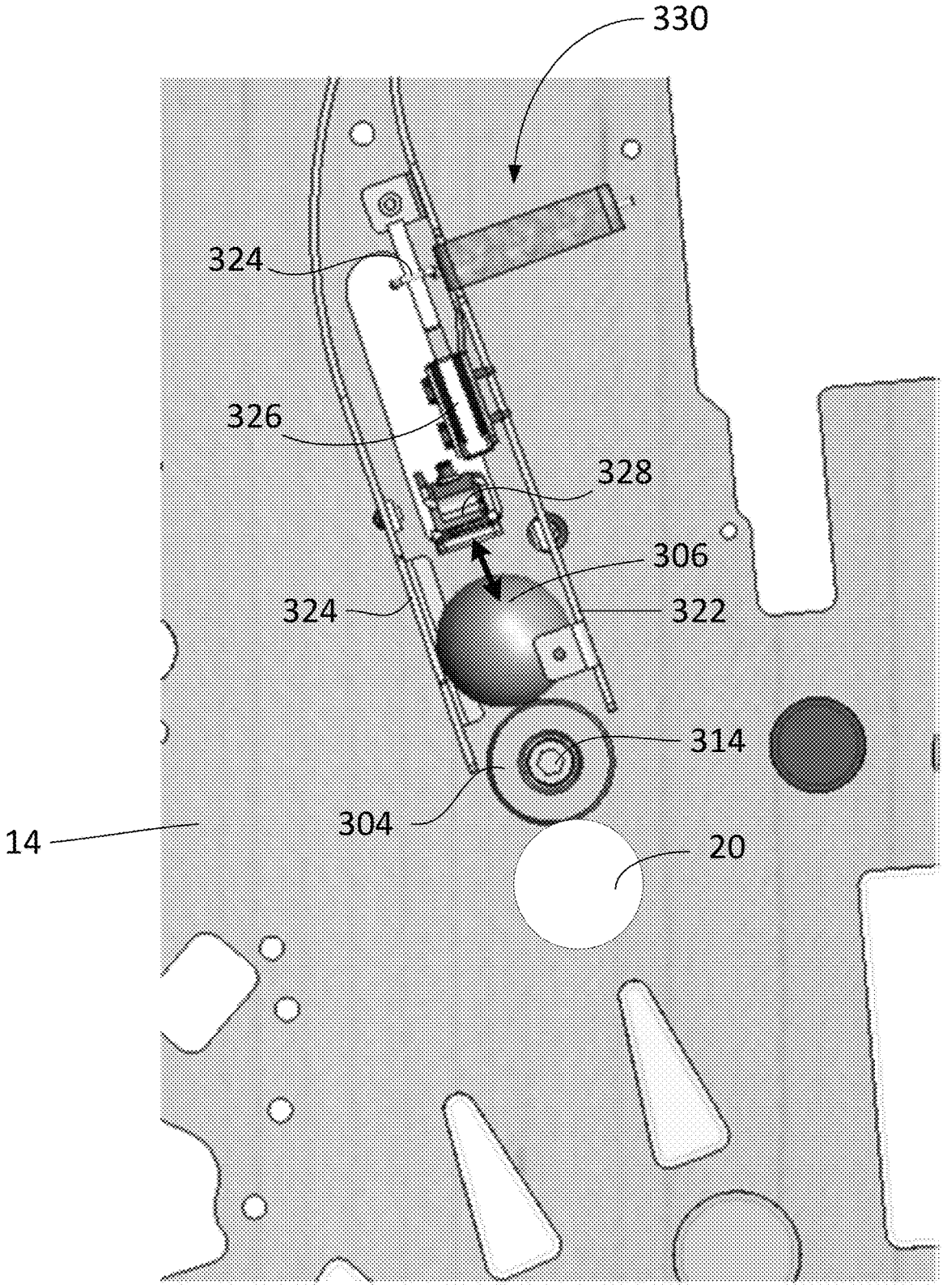
FIG. 8 is a top plan view of the example electromagnetic newton ball and ball diverter assembly of FIG. 4.

In this example, activation of the target element 328 may, depending upon game play conditions, cause the processing device 42 to energize the electromagnetic coil 305 thereby causing the magnet core 303 to be magnetized and attract the ball 20 (see FIG. 8). It will be appreciated that the amount of time and/or pattern of energization of the electromagnetic coil 305 by the processing device 42 may be varied for various gameplay features. For instance, the electromagnetic coil 305 may be effectively left energized by the processing device 42 to hold or capture the ball 20 such as for a multi-ball feature, or may be temporarily energized to affect the path and/or speed of the ball 20 (i.e. to change the velocity of the ball 20) to change gameplay.

As further illustrated, the example guide assembly 320 also includes an optional, sensor assembly 330 located proximate to the guide assembly 320 to detect a location of the ball 20, such as for instance when the ball 20 travels or is guided around the outside of the side rail 322. It will be appreciated that the sensor assembly 330 may be any suitable sensor, including an optical sensor, hall effect sensor, roll-over switch sensor, gate switch, etc., and may be located in any suitable position to detect the location of the ball 20. In this example, the sensor assembly 330 is spinning target assembly having a spinning gate 332 having an arm 334 that actuates a mechanical switch 336 when the ball 20 impacts or passes through the spinning gate 332 causing the spinning gate 332 and the arm 334 to spin about its axis.

Figure 9:
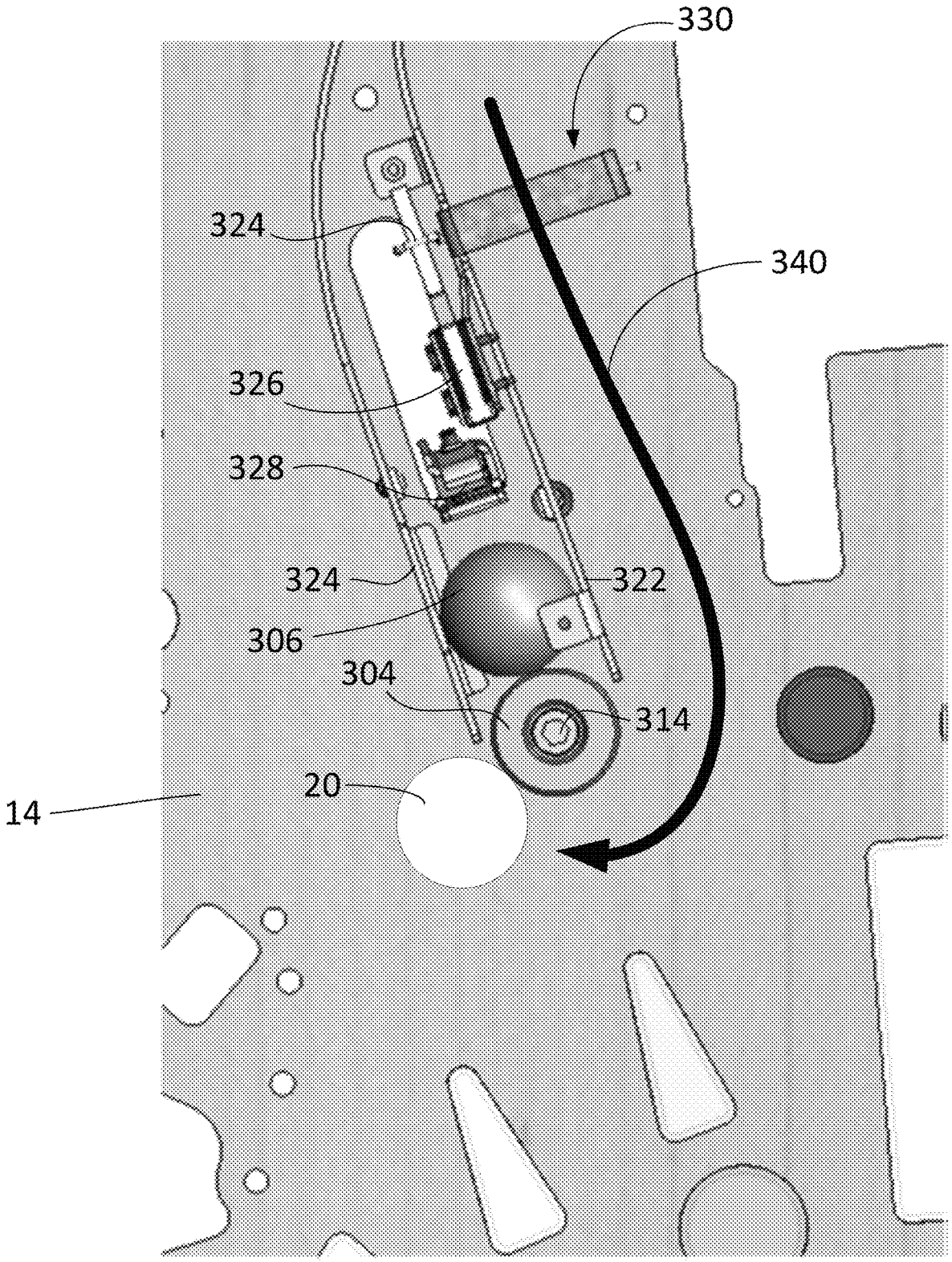
FIG. 9 is a top plan view of the example electromagnetic newton ball and ball diverter assembly of FIG. 8, showing a game ball being diverted.

As illustrated in FIG. 9, in another mode of operation, with the present arrangement of the sensor assembly 330 on the guide assembly 320, during gameplay when the ball 20 travels along the guide assembly 320 in the direction of the arrow 340, the spinning gate 332 is rotated to cause the arm 334 to actuate the mechanical switch 336, which is electrically coupled to the processing device 42, to thereby inform the processing device 42 of the location of the ball 20. The processing device 42 may, depending upon gameplay rules, energize the electromagnetic coil 305 to attract the ball 20 and alter the normal travel path of the ball 20. In this example, the travel path of the ball 20 is altered to travel around or sling-shot around the cap 304 and the ball 20 may actually travel back up the outer side of the side rail 324.

It will be appreciated that the intensity, timing, and/or energization pattern of the electromagnetic coil 305 may cause different changes to the path of the ball 20 to vary gameplay and provide an enhanced game experience for the player. Further, it will be appreciated that, as noted above, the type of ball sensor and/or location of the ball sensor near the electromagnet assembly 300 may be varied to cause different ball path modifications for different ball locations.

While specific examples of the present invention have been disclosed in detail, it will be appreciated by one of ordinary skill in the art that that various modifications and alternatives to those details could be developed in light of the overall teachings of the disclosure. Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

What is claimed is:

1. A ball momentum transfer assembly for a pinball machine, the ball momentum transfer assembly comprising:
- a guide assembly defining a captive ball travel area on a playfield;
- a travel ball disposed within the captive ball travel area;
- a target element mountable to the playfield adjacent a first location of the guide assembly;
- a selectively magnetizable, impact object operatively coupled to the target element and fixedly mountable to the playfield adjacent a second location of the guide assembly opposite the target element, the travel ball located within the captive ball travel area such that the travel ball rests against the impact object to receive momentum from an impact against the impact object when the impact object is struck by a game ball moving across the playfield to cause the travel ball to impact the target element and upon impact, selectively magnetize or demagnetize the impact object.

2. The ball momentum transfer assembly of claim 1, wherein the impact object is an electromagnet.

3. The ball momentum transfer assembly of claim 2, wherein the electromagnet comprises a magnet core extending through the playfield and an electromagnetic coil mounted below the playfield and at least partially surrounding the magnet core such that energization of the electromagnetic core causes the magnet core to be magnetized.

4. The ball momentum transfer assembly of claim 3, further comprising a magnet core cap mountable to the magnet core and located at least partially above the playfield such that the travel ball rest against the magnet core cap.

5. The ball momentum transfer assembly of claim 4, wherein the magnet core cap is stainless-steel.

6. The ball momentum transfer assembly of claim 3, wherein the target element is an impact sensor electrically coupled to the electromagnet such that when the target element is impacted, the impact sensor causes the electromagnet to be magnetized.

7. The ball momentum transfer assembly of claim 6, wherein the impact sensor is a leaf spring switch.

8. The ball momentum transfer assembly of claim 1, wherein the guide assembly comprises a pair of upstanding side rails.

9. The ball momentum transfer assembly of claim 8, further comprising a ball sensor assembly mounted adjacent the guide assembly and operably coupled to impact object, the ball sensor configured to detect a presence of the game ball moving proximate the impact object and upon detection of the presence of the game ball, the ball sensor assembly configured to selectively magnetize or demagnetize the impact object to affect a movement of the game ball.

10. The ball momentum transfer assembly of claim 9, wherein the ball sensor assembly comprises a spinning gate mounted adjacent the guide assembly and above the playfield, the spinning gate comprising an arm coupled to a switch to detect movement of the arm.

11. The ball momentum transfer assembly of claim 9, wherein the ball sensor assembly is mounted to a first side of the guide assembly and the ball sensor assembly is configured to detect movement of the game ball along the first side of the guide assembly towards the impact object and to magnetize the impact object when movement along the first side of the guide assembly towards the impact object is detected.

12. The ball momentum transfer assembly of claim 11, wherein magnetization of the impact object when movement along the first side of the guide assembly towards the impact object is detected causes the game ball to travel around the impact object and along a second side of the guide assembly away from impact object.

13. A pinball machine comprising:

a game cabinet supporting a playfield;

a guide assembly defining a captive ball travel area on the playfield;

a travel ball disposed within the captive ball travel area;

a target element mountable to the playfield adjacent a first location of the guide assembly;

a selectively magnetizable, impact object operatively coupled to the target element and fixedly mountable to the playfield adjacent a second location of the guide assembly opposite the target element, the travel ball located within the captive ball travel area such that the travel ball rests against the impact object to receive momentum from an impact against the impact object when the impact object is struck by a game ball moving across the playfield to cause the travel ball to impact the target element and upon impact, selectively magnetize or demagnetize the impact object.

14. The pinball machine of claim 13, wherein the impact object is an electromagnet capable of being magnetized and demagnetized.

15. The pinball machine of claim 14, wherein the electromagnet comprises a magnet core extending through the playfield, a magnet core cap mountable to the magnet core and located at least partially above the playfield such that the travel ball rest against the magnet core cap, and an electromagnetic coil mounted below the playfield and at least partially surrounding the magnet core such that energization of the electromagnetic core causes the magnet core to be magnetized.

16. The pinball machine of claim 14, wherein the target element comprises an impact sensor electrically coupled to the electromagnet such that when the target element is impacted, the impact sensor causes the electromagnet to be magnetized.

17. The pinball machine of claim 16, wherein the impact sensor is a leaf spring switch.

18. The pinball machine of claim 13, wherein the guide assembly comprises a pair of upstanding side rails.

19. The pinball machine of claim 18, further comprising a ball sensor assembly mounted adjacent the guide assembly and operably coupled to the impact object, the ball sensor configured to detect a presence of the game ball moving proximate the impact object and upon detection of the presence of the game ball, the ball sensor assembly configured to selectively magnetize or demagnetize the impact object to affect a movement of the game ball.

20. The pinball machine of claim 19, wherein the ball sensor assembly is mounted to a first side of the guide assembly and the ball sensor assembly is configured to detect movement of the ball along the first side of the guide assembly towards the impact object and to magnetize the impact object when movement along the first side of the guide assembly towards the impact object is detected and wherein magnetization of the impact object when game ball movement along the first side of the guide assembly towards the impact object is detected causes the game ball to travel around the impact object and along a second side of the guide assembly away from impact object.

* * * * *